US007941315B2

(12) United States Patent
Matsuo

(10) Patent No.: US 7,941,315 B2
(45) Date of Patent: May 10, 2011

(54) NOISE REDUCER, NOISE REDUCING METHOD, AND RECORDING MEDIUM

(75) Inventor: Naoshi Matsuo, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 751 days.

(21) Appl. No.: 11/385,653

(22) Filed: Mar. 22, 2006

(65) Prior Publication Data

US 2007/0156399 A1 Jul. 5, 2007

(30) Foreign Application Priority Data

Dec. 29, 2005 (JP) ..... 2005-380660

(51) Int. Cl.
*G10L 21/02* (2006.01)

(52) U.S. Cl. ..... 704/226; 704/233; 704/E19.014; 704/E21.002; 704/E21.009; 704/E21.014

(58) Field of Classification Search ..... 704/226, 704/233, E15.038, E19.014, E21.002, E21.009, 704/E21.014, E15.039; 702/191
See application file for complete search history.

(56) References Cited

U.S. PATENT DOCUMENTS 4,630,305 A * 12/1986 Borth et al. ..... 381/94.3
5,012,519 A * 4/1991 Adlersberg et al. ..... 704/226
5,400,409 A * 3/1995 Linhard ..... 381/92
5,668,927 A * 9/1997 Chan et al. ..... 704/240
5,742,927 A * 4/1998 Crozier et al. ..... 704/226
5,839,101 A * 11/1998 Vahatalo et al. ..... 704/226
5,933,495 A * 8/1999 Oh ..... 379/406.08
5,974,373 A * 10/1999 Chan et al. ..... 704/200
6,035,048 A * 3/2000 Diethorn ..... 381/94.3
6,108,610 A * 8/2000 Winn ..... 702/77
6,266,633 B1 * 7/2001 Higgins et al. ..... 704/224

(Continued)

FOREIGN PATENT DOCUMENTS

JP 9-258792 10/1997

(Continued)

OTHER PUBLICATIONS

M. Berouti, R. Schwartz, J. Makhoul, Enhancement of speech corrupted by acoustic noise, Proceedings of the Fourth IEEE International Conference on Acoustics, Speech, and Signal Processing, ICASSP-79, Washington, DC, Apr. 2-4, 1979, pp. 208-211.*

(Continued)

*Primary Examiner* — Richemond Dorvil
*Assistant Examiner* — Greg Borsetti
(74) *Attorney, Agent, or Firm* — Kratz, Quintos & Hanson, LLP

(57) ABSTRACT

Accepting the speech having the noise superimposed thereon and converting it into a signal on a time axis of the speech, an amplitude component of a speech for each predetermined frequency band of the converted signal on the frequency axis is calculated. Calculating a noise reduction coefficient, the noise component is reduced by multiplying the signal on the frequency axis of the original signal by the calculated noise reduction coefficient. By estimating the target value of the remaining noise for each frequency band, a signal on a frequency axis in which a signal corresponding to a frequency band of which target value estimated by the noise target value is larger than the value of the amplitude component of the signal on the frequency axis of which noise component is reduced is corrected to a signal corresponding to the target value is restored, into a signal on a time axis.

9 Claims, 7 Drawing Sheets

U.S. PATENT DOCUMENTS

| | | | | |
|---|---|---|---|---|
| 6,289,309 | B1 * | 9/2001 | deVries | 704/233 |
| 6,351,731 | B1 * | 2/2002 | Anderson et al. | 704/233 |
| 6,363,345 | B1 * | 3/2002 | Marash et al. | 704/226 |
| 6,377,637 | B1 * | 4/2002 | Berdugo | 375/346 |
| 6,415,253 | B1 * | 7/2002 | Johnson | 704/210 |
| 6,453,289 | B1 * | 9/2002 | Ertem et al. | 704/225 |
| 6,519,559 | B1 * | 2/2003 | Sirivara | 704/227 |
| 6,708,145 | B1 * | 3/2004 | Liljeryd et al. | 704/200.1 |
| 6,757,395 | B1 * | 6/2004 | Fang et al. | 381/94.3 |
| 6,768,979 | B1 * | 7/2004 | Menendez-Pidal et al. | 704/226 |
| 6,810,273 | B1 * | 10/2004 | Mattila et al. | 455/570 |
| 7,133,825 | B2 * | 11/2006 | Bou-Ghazale | 704/233 |
| 7,243,065 | B2 * | 7/2007 | Stephens et al. | 704/226 |
| 7,289,626 | B2 * | 10/2007 | Carter et al. | 379/387.02 |
| 7,349,841 | B2 * | 3/2008 | Furuta et al. | 704/226 |
| 2003/0128851 | A1 * | 7/2003 | Furuta | 381/94.2 |
| 2004/0204934 | A1 * | 10/2004 | Stephens et al. | 704/226 |
| 2005/0091049 | A1 * | 4/2005 | Yang et al. | 704/226 |
| 2005/0119882 | A1 * | 6/2005 | Bou-Ghazale | 704/227 |
| 2005/0240401 | A1 * | 10/2005 | Ebenezer | 704/226 |
| 2007/0110263 | A1 * | 5/2007 | Brox | 381/110 |

FOREIGN PATENT DOCUMENTS

| | | | |
|---|---|---|---|
| JP | 2000-321080 | | 11/2000 |
| JP | 2001-249676 | | 9/2001 |
| JP | 2002-140100 | | 5/2002 |
| JP | 2005258158 | A * | 9/2005 |

OTHER PUBLICATIONS

R. Martin, Spectral subtraction based on minimum statistics, Proceedings of the Seventh European Signal Processing Conference, EUSIPCO-94, Edinburgh, Scotland, Sep. 13-16, 1994, pp. 1182-1185.*

Martin. "Noise Power Spectral Density Estimation Based on Optimal Smoothing and Minimum Statistics" 2001.*

Cohen et al. "Noise Estimation by Minima Controlled Recursive Averaging for Robust Speech Enhancement" 2002.*

Doblinger, Gerhard (1995): "Computationally efficient speech enhancement by spectral minima tracking in subbands", in EUROSPEECH-1995, 1513-1516.*

* cited by examiner

NOISE REDUCER, NOISE REDUCING METHOD, AND RECORDING MEDIUM

CROSS-REFERENCE TO RELATED APPLICATIONS

This Nonprovisional application claims priority under 35 U.S.C. §119(a) on Patent Application No. 2005-380660 filed in Japan on Dec. 29, 2005, the entire contents of which are hereby incorporated by reference.

BACKGROUND OF THE INVENTION

1. Field of the Invention

The present invention relates to a noise reducer, a noise reducing method, and a computer program, which serve to reduce a noise by reducing a spectrum component of a noise signal from the spectrum component of the inputted signal in which the noise signal is superimposed on a speech signal.

2. Description of the Related Art

Due to development of a computer technology in recent years, a recognition accuracy of speech recognition has been rapidly improved. Then, in order to further improve the speech recognition accuracy, as preparation for the inputted speech, various noise reducers to reduce a noise including nonstationary noise such as speech and a musical composition other than a target of recognition by the audio processing have been improved.

FIG. 7 is a block diagram showing a constitutional example of a conventional noise reducer. As shown in FIG. 7, the conventional noise reducer is provided with a speech accepting part 701, a signal converting part 702, a noise reducing part 703, a signal restoring part 704, an amplitude calculating part 705, and a coefficient calculating part 706.

The speech accepting part 701 accepts input of speech. The signal converting part 702 converts a signal on a time axis of the inputted speech into a signal on a frequency axis. The amplitude calculating part 705 calculates the amplitude component of the signal on the frequency axis, and the coefficient calculating part 706 calculates a noise reduction coefficient.

In FIG. 7, the speech including the noise is accepted by the speech accepting part 701 to be converted into the signal on the frequency axis by the signal converting part 702. For example, in the signal converting part 702, time-frequency conversion processing such as a Fourier transform and a plurality of band pass filtering processing such as sub band decomposition processing or the like are carried out.

The signal on the frequency axis that is converted by the signal converting part 702 is multiplied by a coefficient due to the noise reducing part 703. The coefficient of the noise reducing part 703 is a noise reduction coefficient to be described later. For example, in a frequency band only containing a speech, a coefficient is defined as "1" and in the frequency band only containing noise, a coefficient is defined as "0" or a sufficiently small value.

The signal of which noise is reduced by the noise reducing part 703 is converted from the signal on the frequency axis into the signal on the time axis by the signal restoring part 704 to be outputted. The processing of the signal restoring part 704 is the inverse transformation of the signal converting part 702.

The signal on the frequency axis that is converted by the signal converting part 702 is also inputted to the amplitude calculating part 705. The amplitude calculating part 705 calculates the amplitude component of the inputted signal for each frequency band. The coefficient calculating part 706 extracts the amplitude component at the frequency band where only a noise exists on the basis of the amplitude component of the inputted signal that is calculated by the amplitude calculating part 705 by using the variation amounts or the like in the time axial direction of the inputted signal and calculates a noise reduction coefficient by using an amplitude component of a signal (a stationary noise signal) only including the extracted noise.

As described above, according to the conventional noise reducer, by assuming that there is no correlativity between the noise signal and the speech signal and estimating that the amplitude component at the frequency band where the noise only exists is the amplitude component of the stationary noise signal, the amplitude component of the noise is subtracted from the amplitude component of the inputted signal at each frequency band or by carrying out the level reduction equivalent to the subtraction, the noise is reduced.

In addition, according to the above-described noise reduction, the amplitude component of the noise is subtracted from the amplitude component of the inputted signal in excess, so that this involves a problem such that the speech signal and the remaining noise or the like are distorted. In other words, reduction of the speech signal and the noise or the like in excess generates a discontinuous point in the outputted signal and a friction sound, a so-called musical noise or the like is generated. In order to solve such a problem, for example, the noise reducer disclosed in Japanese Patent Application Laid-Open 2001-249676 is provided with a target value setting part 707 for setting a target value of reduction of the noise so as to prevent the speech signal from being distorted by only subtracting the amplitude component of the noise till this target value.

BRIEF SUMMARY OF THE INVENTION

The present invention has been made taking the foregoing problems into consideration and an object of which is to provide a noise reducer, a noise reducing method, and a computer program, which can prevent a speech signal to be outputted from distorted by estimating a target value that reduces the noise on the basis of the speech signal having the inputted noise mixed.

In order to attain the above-described object, a noise reducer according to a first invention may comprise a speech accepting part for accepting a speech on which a noise is superimposed and converting it into a signal on a time axis of the speech; a signal converting part for converting the signal on the time axis of the speech into a signal on a frequency axis; an amplitude calculating part for calculating an amplitude component for each predetermined frequency band of the signal on the frequency axis converted by the signal converting part; a coefficient calculating part for calculating a noise reduction coefficient to reduce the noise for each frequency band on the basis of the amplitude component calculated by the amplitude calculating part; a noise reducing part for multiplying the signal on the frequency axis of the original signal by the calculated noise reduction coefficient to reduce the noise component in the converted signal on the frequency axis; and a signal restoring part for restoring the signal on the frequency axis of which noise component is reduced into the signal on the time axis; wherein the noise reducer may comprise a noise target value estimating part that estimates a target value of the remaining noise for each frequency band on the basis of the accepted speech; and the signal restoring part restores a signal on a frequency axis in which a signal corresponding to a frequency band of which target value estimated by the noise target value is larger than the value of the amplitude component of the signal on the frequency axis of which noise component is reduced by the noise reducing part is corrected to a signal corresponding to the target value estimated by the noise target value estimating part, into a signal on a time axis.

Further, in the noise reducer according to a second invention the noise target value estimating part may comprise, in the first invention, means for accepting an initial value of a target value of the remaining noise; first determination means for determining whether an index value representing an amplitude component of a predetermined frequency band among the signals on the frequency axis converted by the signal converting part is larger than the target value or not; means for setting a time constant for averaging the signal on the frequency axis of the frequency band being smaller (larger) than a predetermined value when the first determination unit determines that the index value is smaller (larger) than the target value so as to estimate the amplitude component of the noise; means for setting the index value representing the estimated amplitude component of the noise as a new target value in the frequency band; second determination means for determining whether the above-described processing has been completed in the all frequency bands or not; and means for repeating the above-described processing when the second determination means determines that the processing has not been completed and sets the index value representing the amplitude component of the noise estimated for each frequency band as the target value of the remaining noise when the second determination means determines that the processing has been completed.

In addition, a noise reducer according to a third invention may comprise a processor capable for performing the steps of: accepting the speech having the noise superimposed thereon and converting it into a signal on a time axis of the speech; converting the signal on the time axis of the speech into a signal on a frequency axis; calculating an amplitude component of a speech for each predetermined frequency band of the converted signal on the frequency axis; calculating a noise reduction coefficient for reducing the noise for each frequency band on the basis of the calculated amplitude component; reducing the noise component in the converted signal on the frequency axis by multiplying the signal on the frequency axis of the original signal by the calculated noise reduction coefficient; restoring the signal on the frequency axis of which noise component is reduced into a signal on a time axis; and restoring a signal on a frequency axis in which a signal corresponding to a frequency band of which target value estimated by the noise target value is larger than the value of the amplitude component of the signal on the frequency axis of which noise component is reduced by the noise reducing part is corrected to a signal corresponding to the target value estimated by the noise target value estimating part, into a signal on a time axis.

Further, a noise reducer according to a fourth invention may comprise, in the third invention, a processor for performing the steps of accepting an initial value of a target value of the remaining noise; determining if an index value representing an amplitude component of a predetermined frequency band among the converted signals on the frequency axis is larger than the target value or not; setting a time constant for averaging the signal on the frequency axis of the frequency band being smaller (larger) than a predetermined value when determining that the index value is smaller (larger) than the target value so as to estimate the amplitude component of the noise; setting the index value representing the estimated amplitude component of the noise as a new target value in the frequency band; determining if the above-described processing has been completed in the all frequency bands; and repeating the above-described processing when determining that the processing has not been completed and setting the index value representing the amplitude component of the noise estimated for each frequency band as the target value of the remaining noise when determining that the processing has been completed.

In addition, a noise reducing method according to a fifth invention may comprise the steps of accepting the speech having the noise superimposed thereon and converting it into a signal on a time axis of the speech; converting the signal on the time axis of the speech into a signal on a frequency axis; calculating an amplitude component of a speech for each predetermined frequency band of the converted signal on the frequency axis; calculating a noise reduction coefficient for reducing the noise for each frequency band on the basis of the calculated amplitude component; reducing the noise component in the converted signal on the frequency axis by multiplying the signal on the frequency axis of the original signal by the calculated noise reduction coefficient; and restoring the signal on the frequency axis of which noise component is reduced into a signal on a time axis; wherein the method estimates a target value of the remaining noise for each frequency band on the basis of the accepted speech; and restores a signal on a frequency axis in which a signal corresponding to a frequency band of which target value estimated by the noise target value is larger than the value of the amplitude component of the signal on the frequency axis of which noise component is reduced by the noise reducing part is corrected to a signal corresponding to the target value estimated by the noise target value estimating part, into a signal on a time axis.

Further, the noise reducing method according to a sixth invention may comprise, in the fifth invention, the steps of accepting an initial value of a target value of the remaining noise; determining if an index value representing an amplitude component of a predetermined frequency band among the converted signals on the frequency axis is larger than the target value or not; setting a time constant for averazing the signal on the frequency axis of the frequency band being smaller (larger) than a predetermined value when determining that the index value is smaller (larger) than the target value so as to estimate the amplitude component of the noise; setting the index value representing the estimated amplitude component of the noise as a new target value in the frequency band; determining if the above-described processing has been completed in the all frequency bands; and repeating the above-described processing when determining that the processing has not been completed and setting the index value representing the amplitude component of the noise estimated for each frequency band as the target value of the remaining noise when determining that the processing has been completed.

In addition, a computer program according to a seventh invention can be executed by a computer and it causes the computer to function as a speech accepting part that accepts a speech on which a noise is superimposed and converts it into a signal on a time axis of the speech; a signal converting part that converts the signal on the time axis of the speech into a signal on a frequency axis; an amplitude calculating part that calculates an amplitude component for each predetermined frequency band of the signal on the frequency axis converted by the signal converting part; a coefficient calculating part that calculates a noise reduction coefficient to reduce the noise for each frequency band on the basis of the amplitude component calculated by the amplitude calculating part; a noise reducing part that multiplies the signal on the frequency axis of the original signal by the calculated noise reduction coefficient to reduce the noise component in the converted signal on the frequency axis; and a signal restoring part that restores the signal on the frequency axis of which noise component is reduced into the signal on the time axis. Further, the computer program causes the computer to function as a noise target value estimating part that estimates a target value of the remaining noise for each frequency band on the basis of the accepted speech; and causes the signal restoring part to restore a signal on a frequency axis in which a signal corresponding to a frequency band of which target value estimated by the noise target value is larger than the value of the amplitude component of the signal on the frequency axis of which noise component is reduced by the noise reducing part is corrected to a signal corresponding to the target value estimated by the noise target value estimating part, into a signal on a time axis.

Further, a computer program according to an eighth invention causes, in the seventh invention, the computer to function as a unit which accepts an initial value of a target value of the remaining noise; a first determination unit which determines if an index value representing an amplitude component of a predetermined frequency band among the signals on the frequency axis converted by the signal converting part is larger than the target value or not; a unit which sets a time constant for averaging the signal on the frequency axis of the frequency band being smaller (larger) than a predetermined value when the first determination unit determines that the index value is smaller (larger) than the target value so as to estimate the amplitude component of the noise; a unit which sets the index value representing the estimated amplitude component of the noise as a new target value in the frequency band; a second determination unit which determines if the above-described processing has been completed in the all frequency bands; and a unit which repeats the above-described processing when the second determination means determines that the processing has not been completed and sets the index value representing the amplitude component of the noise estimated for each frequency band as the target value of the remaining noise when the second determination means determines that the processing has been completed.

According to the first, third, fifth, and seventh inventions, accepting the speech having the noise superimposed thereon, converting the speech into the signal on the time axis of this speech, and converting the signal on the time axis of this speech into a signal on a frequency axis, the amplitude component of the speech for every predetermined frequency band is calculated. On the basis of the calculated amplitude component, the noise reduction coefficient to reduce the noise for each frequency band is calculated; the signal on the frequency axis of the original signal is multiplied by the calculated noise reduction coefficient to reduce the noise component in the signal on the converted frequency axis; and a signal on the frequency axis of which noise component is reduced is restored as a signal on the time axis. Estimating a target value of the remaining noise for each frequency band on the basis of the accepted speech, a signal corresponding to a frequency band of which estimated target value is larger than the value of the amplitude component of the signal on the frequency axis of which noise component is reduced is corrected to a signal corresponding to the estimated target value and then, it is restored into a signal on a time axis. Thereby, even if the speech signal other than the speech signal of the recognition target is superimposed and the speech input of which period of time only including a stationary noise cannot be specified is accepted, it is possible to output the speech without reducing the noise in excess, with less distortion, and with high quality substantially in real time.

According to the second, fourth, sixth, and eighth inventions, accepting an initial value of the target value of the remaining noise, it is determined whether the target value representing the amplitude component of a predetermined frequency band in the signals on the converted frequency axis is larger than the target value or not. If it is smaller (larger) than the target value, a time constant to average the signal on the frequency axis of that frequency band is set to be smaller (larger) than a predetermined value, the amplitude component of the noise is estimated; and the target value representing the amplitude component of the estimated noise is set as a new target value in that frequency band. Determining if the above-described processing has been completed in the all frequency bands, if it is not completed, the above-described processing is repeated, and if it is completed, the target value representing the amplitude component of the noise estimated for each frequency band is set as the target value of the remaining noise. Thereby, even if the nonstationary signal other than the speech signal as the recognition target is superimposed and the speech input of which period of time only including a stationary noise cannot be specified is accepted, it is possible to output the speech without reducing the noise in excess, with less distortion, and with high quality substantially in real time.

According to the first, third, fifth, and seventh inventions, even if the speech signal other than the speech signal as the recognition target is superimposed and the speech input of which period of time only including a stationary noise cannot be specified is accepted, it is possible to output the speech without reducing the noise in excess, with less distortion, and with high quality substantially in real time.

According to the second, fourth, sixth or eighth inventions, even if the speech signal other than the speech signal as the recognition target is superimposed and the speech input of which period of time only including a stationary noise cannot be specified is accepted, it is possible to estimate the target value reducing the noise for each frequency band of a signal and to output the speech without reducing the noise in excess, with less distortion, and with high quality substantially in real time.

The above and further objects and features of the invention will more fully be apparent from the following detailed description with accompanying drawings.

DETAILED DESCRIPTION OF THE INVENTION

The above-described noise reducer estimates the amplitude component of the noise signal based on the assumption that there is a period of time only having a noise. Accordingly, when one speaker inputs speech, it is necessary for the other speaker to become silent. However, in the usage environment in real, it is difficult to avoid generation of a conversation of a third person as a background noise, so that there is a possibility that the false recognition occurs.

In addition, in the case of setting the target value of the noise reduction so as to prevent distortion of the speech signal, it is necessary to repeat the noise reduction processing in several times on a trial basis with respect to the speech that is actually inputted and the appropriate target value is specified in order to have the appropriate target value. Accordingly, since the amplitude spectrum of the conversation of the other person generated as the background noise is not constant in time series when the noise reducer is used in the bustle of a city, it is difficult to reduce the noise effectively and it is feared that distortion of the speech signal due to the excess noise reduction cannot be prevented appropriately.

The present invention has been made taking the foregoing problems into consideration and an object of which is to provide a noise reducer, a noise reducing method, and a computer program, which can prevent a speech signal to be outputted from distorted by estimating a target value that reduces the noise on the basis of the speech signal having the inputted noise mixed. The present invention will be realized in the following embodiments.

First Embodiment

Figure 1:
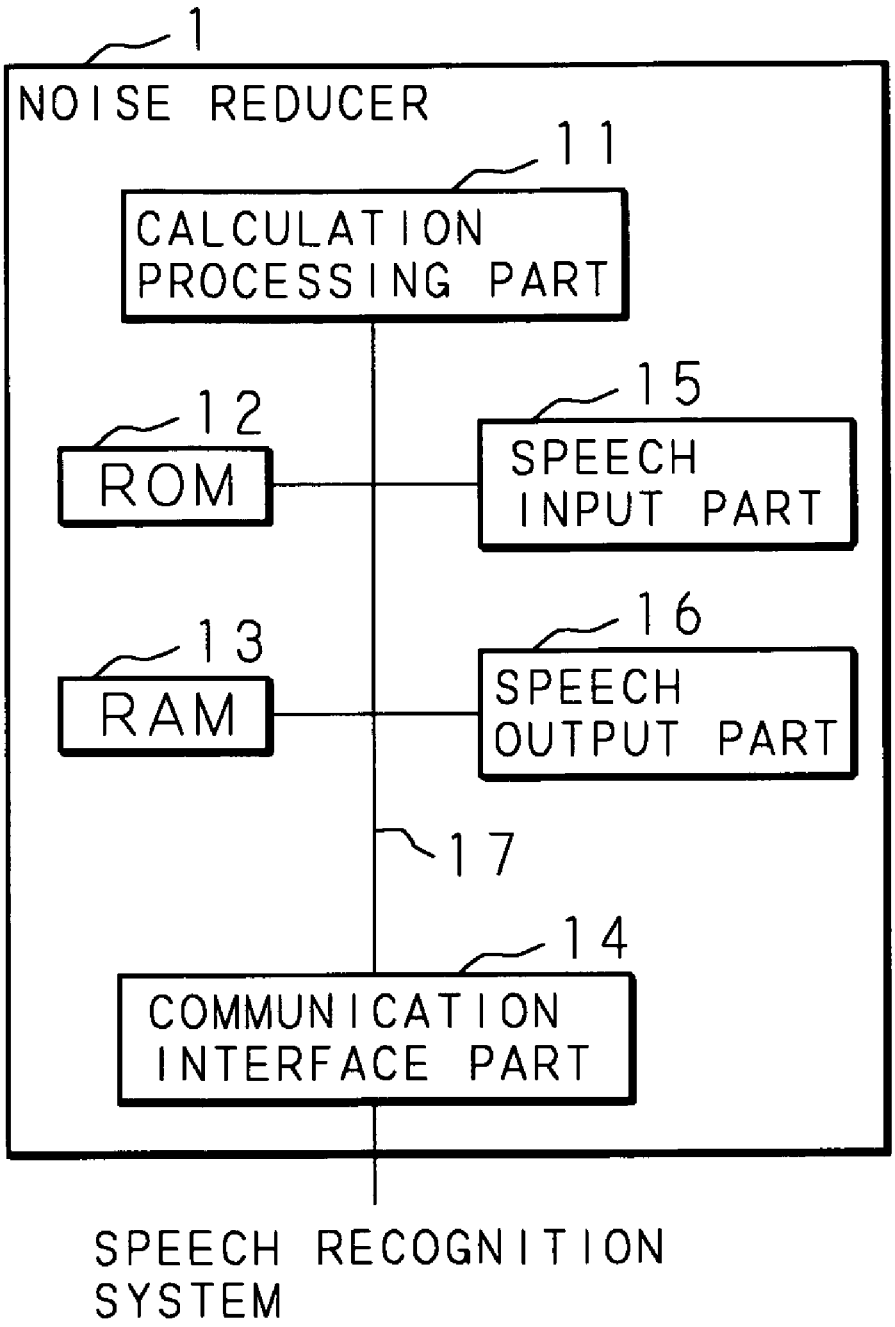
FIG. 1 is a block diagram showing the structure of a computer realizing a noise reducer according to an embodiment of the present invention.

Hereinafter, the present invention will be described with reference to the drawings showing the embodiments thereof. FIG. 1 is a block diagram showing the structure of a computer realizing a noise reducer according to an embodiment of the present invention. The computer according to a noise reducer 1 according to the embodiment of the present invention is at least provided with a calculation processing part 11 such as a CPU and a DSP, a ROM 12, a RAM 13, a communication interface part 14 capable of make the data communication with respect to the outer computer, a speech input part 15 for accepting the input of the speech, and a speech output part 16 for outputting the voice of which noise is reduced.

The calculation processing part 11 is connected to every part of the above-described hardware of the noise reducer 1 via an inner bus 17 and may control every part of the above-described hardware and may execute various software functions in accordance with a processing program stored in the ROM 12, for example, a program to convert a signal on a time axis of the speech having a noise superimposed thereon, a program to calculate the amplitude component for each analysis window of the converted signal on a frequency axis, a program to estimate the target value of the remaining noise based on the accepted speech signal, a program to calculate the noise reduction coefficient based on the calculated amplitude component of the speech signal and the estimated target value, a program to multiply the converted signal on the frequency axis by the calculated noise reduction coefficient, and a program to restore the signal on the frequency axis multiplied by the noise reduction coefficient into the signal on the time axis or the like.

The ROM 12 is configured by a flash memory or the like and stores the processing program necessary for allowing the present embodiment to function as the noise reducer 1. The RAM 13 is configured by a SRAM or the like and stores the time data generated upon execution of the software. The communication interface part 14 may download the above-described program from the external computer or may transmit a speech output signal to a speech recognition system.

The speech input part 15 is a microphone to accept the speech and a microphone array that is configured by a plurality of microphones is more preferable. The speech output part 16 is an output device such as a speaker.

Figure 2:
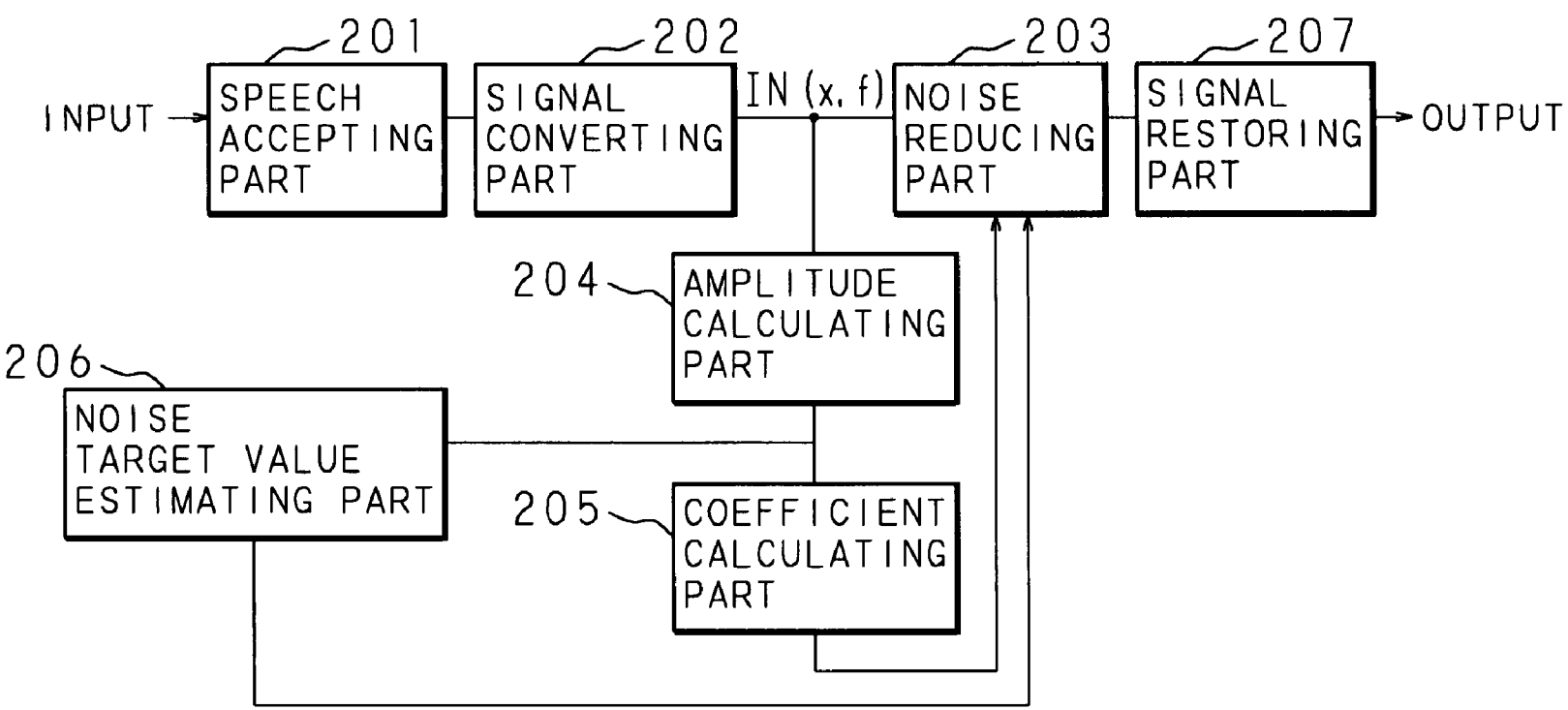
FIG. 2 is a block diagram showing the functional structure that is executed by a calculation processing part of the noise reducer according to an embodiment of the present invention.

FIG. 2 is a block diagram showing the functional structure that is executed by a calculation processing part 11 of the noise reducer 1 according to an embodiment of the present invention. As shown in FIG. 2, the noise reducer is provided with a noise target value estimating part 206 to estimate a target value of the remaining noise on the basis of the accepted speech signal in addition to a speech accepting part 201, a signal converting part 202, a noise reducing part 203, an amplitude calculating part 204, a coefficient calculating part 205, and a signal restoring part 207.

The speech accepting part 201 may accept input of the speech having stationary noise and nonstationary noise mixed. The signal converting part 202 may convert the signal on the time axis of the inputted speech into the signal on the frequency axis, namely, a spectrum IN (x, f). In this case, x indicates a number of the analysis window on the time axis and f indicates a frequency, respectively. The signal converting part 202 may execute the time-frequency conversion processing such as a Fourier transform and a plurality of band pass filtering processing such as sub band decomposition processing or the like. According to the present embodiment, the signal is converted into a spectrum IN (x, f) by the time-frequency conversion processing such as a Fourier transform.

Figure 3A:
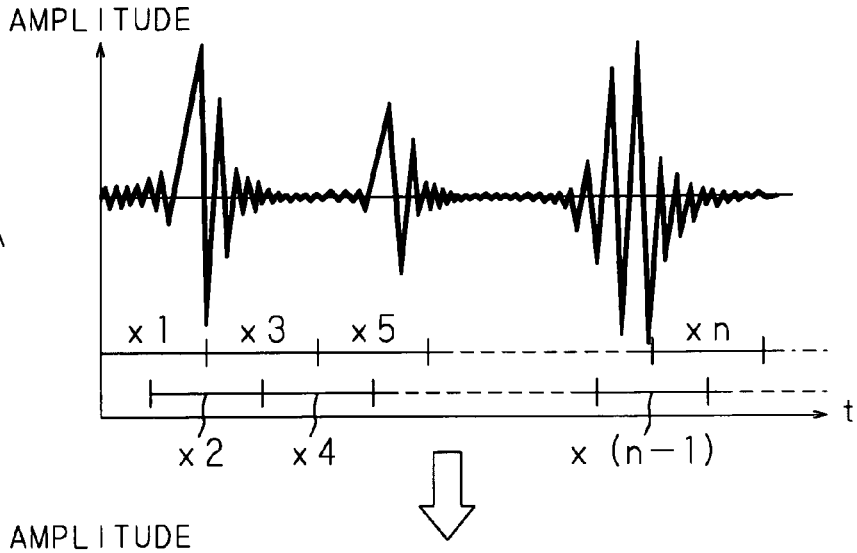
FIGS. 3A and 3B are schematic views of signal conversion.
Figure 3B:
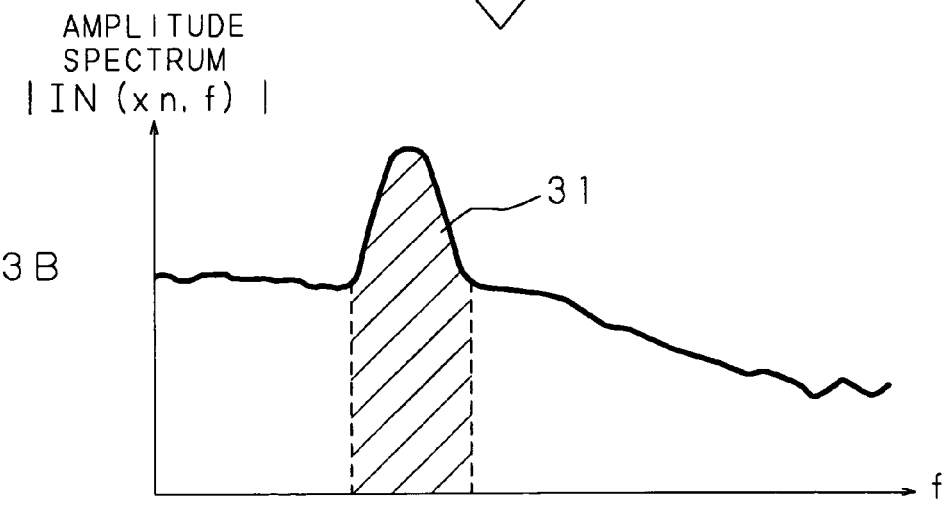

FIG. 3 is a schematic view of signal conversion. It is difficult to only reduce the noise under the condition that a speech waveform having the stationary noise mixed is accepted as the signal on the time axis as shown in FIG. 3A, so that the signal is converted into a spectrum IN (x, f) (x is the analysis window of the Fourier transform and f is a frequency thereof) as shown in FIG. 3B. Further, the analysis window x is overlapped with the adjacent analysis window (x+1) by 50% so that the signal on the frequency axis can be restored into the signal on the time axis. In addition, as shown by a shaded area of amplitude spectrum |IN(xn, f)| in FIG. 3B, estimating that the area where amount of change of a spectrum is larger than a predetermined value as a noise band 31 where a noise is generated and the noise of the noise band 31 is reduced.

The noise reducing part 203 multiplies a spectrum IN (x, f) of the inputted speech by a noise reduction coefficient $\beta(f)$ calculated by the coefficient calculating part 205. Further, the noise reduction coefficient $\beta(f)$ is a noise reduction coefficient having a value not less than 0 and not more than 1 and it is a coefficient that is obtained for each frequency or for each predetermined frequency band. For example, in the frequency or the frequency band including the speech much, the coefficient is brought close to "1" and in the frequency or the frequency band including a stationary noise such as a background noise is brought close to "0".

The signal on the frequency axis that is converted by the signal converting part 202 is also inputted to the amplitude calculating part 204. The amplitude calculating part 204 may calculate a representing value of the amplitude spectrum |IN (x, f)| of the inputted signal for every analysis window of the Fourier transform. The representing value for every analysis window is not specified particularly. The representing value may be an average value for each predetermined frequency band of the amplitude spectrum |IN (x, f)| of the analysis window or it may be the maximum value for each predetermined frequency band of the spectrum amplitude |IN (x, f)| of the analysis window. In addition, the processing using the value for each frequency other than the representing value may be available.

The coefficient calculating part 205 may calculate the noise reduction coefficient β(f) to reduce the noise in units of analysis window x on the basis of the spectrum amplitude |IN (x, f)| of the inputted signal. According to a specific example, after averaging the amplitude spectrum |IN (x, f)| due to a low pass filter or the like, the average value of the spectrum that has been averaged is calculated for each analysis window x to calculate a ratio with respect to the maximum value of the spectrum of the calculated average value. When the calculated rate is 0.5 or more, determining that this analysis window includes the nonstationary noise such as a speech much, the noise reduction coefficient β(f) in this analysis window is brought close to "1". When the calculated rate is smaller than 0.5, determining that this analysis window includes the stationary noise such as a background noise much, the noise reduction coefficient β(f) in this analysis window is brought close to "0". It is obvious that the noise reduction coefficient β(f) may be "0" or "1" depending on the state of the background noise.

The noise target value estimating part 206 may estimate a target value indicating to what level the noise should be reduced for each analysis window x on the basis of the representing value of the amplitude spectrum |IN (x, f)| of the inputted signal for each analysis window, which is calculated by the amplitude calculating part 204. The target value |N (xn, f)| at the arbitrary analysis window xn (n is a natural number) is calculated from a mathematical expression (1) by using the spectrum |N (x (n−1), f)| in the last analysis window x (n−1).

$$|N(xn, f)| = \alpha(f)|N(x(n-1), f)| + (1-\alpha(f))|IN(xn, f)| \quad \text{[Expression 1]}$$

In the expression 1, |IN (xn, f)| indicates the amplitude spectrum of the inputted speech signal and |N (x(n−1), f)| indicates the amplitude spectrum of the target value in the last analysis window x(n−1), respectively. In addition, each of x1, x2, . . . , xn (n is a natural number) indicates the analysis window to convert the signal into one on the frequency axis by the Fourier transform or the like. Further, α(f) is an average coefficient for each frequency. According to the present embodiment, as described above, the adjacent analysis windows are overlapped each other by 50%.

According to the conventional noise reducer, since the target value of the level at which the noise is reduced is determined on the basis of the stationary noise that is inputted in real, the existence of the period of time that only the stationary noise is located is a necessary condition. However, according to the present embodiment, the target value |N (x f) | indicating at what level the noise is reduced is estimated by the above-described procedure for each analysis window x, so that it is possible to estimate the target value of the level at which the noise is reduced not depending on with or without of the period of time only having the stationary noise.

The noise reducing part 203 may calculate a value OUT (xn, f) obtained by multiplying the spectrum IN (xn, f) of the inputted speech by the noise reduction coefficient β(f) calculated by the coefficient calculating part 205 and may compare it with the target value |N(xn, f)| that is estimated by the noise target value estimating part 206. In the case that |OUT (xn, f)| is lower than |N(x(n−1), f)|, it is determined that the noise is reduced over the noise target value. Then, the value of |OUT (xn, f)| is replaced with the value of |N(x(n−1), f)| to be transmitted to the signal restoring part 207.

The signal restoring part 207 may convert the output signal from the noise reducing part 203 into the signal on the time axis and may output it. The processing at the signal restoring part 207 is the reversed conversion processing of the signal converting part 202.

Figure 4:
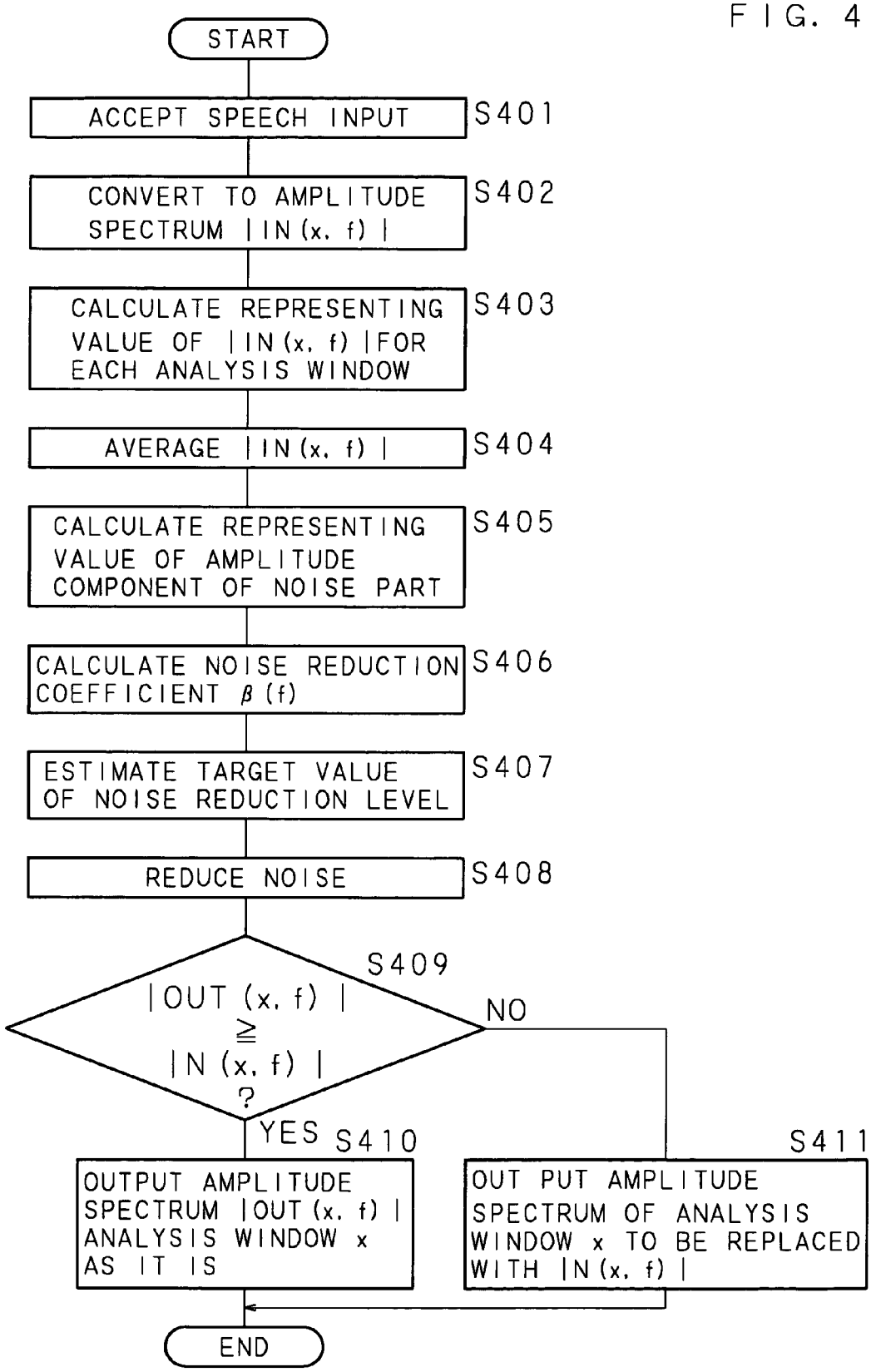
FIG. 4 is a flow chart showing a procedure of the noise reduction processing of a calculation processing part of the noise reducer according to the embodiment of the present invention.

The processing procedure of the calculation processing part 11 of the noise reducer 1 will be described below. FIG. 4 is a flow chart showing a procedure of the noise reduction processing of the calculation processing part 11 of the noise reducer 1 according to the embodiment of the present invention.

In FIG. 4, the calculation processing part 11 of the noise reducer 1 may accept the input of the speech having the stationary noise and the nonstationary noise mixed therein (step S401). The calculation processing part 11 may Fourier-transform the signal on the time axis of the inputted speech into the signal on the frequency axis, namely, the amplitude spectrum |IN (x, f)| (step S402).

The calculation processing part 11 may calculate the representing value of the amplitude spectrum of the input signal, namely, |IN (x, f)| for each analysis window x upon the Fourier transform (step S403). The representing value for each analysis window x is not limited particularly and it may be the average value for each predetermined frequency band of the amplitude spectrum |IN (x, f)| within the analysis window x or it may be the maximum value for each predetermined frequency band of the amplitude spectrum |IN (x, f)| within the analysis window x.

The calculation processing part 11 may average the amplitude spectrum |IN (x, f)| of the inputted signal by a low pass filter or the like (step S404) and may calculate the representing value of the amplitude component of the noise part by calculating the average value of the amplitude spectrum after the average processing (step S405). A calculation processing part 21 may calculate the rate with respect to the maximum value of the amplitude spectrum of the calculated representing value and in accordance with the calculated rate, it may calculate the noise reduction coefficient β(f) (step S406).

Specifically, when the calculated rate is 0.5 or more, the calculation processing part 21 may determine that this analysis window includes many noises such as speech and when the calculated rate is smaller than 0.5, the calculation processing part 21 may determine that this analysis window includes stationary noises such as a background noise.

The calculation processing part 11 may estimate the target value indicating to what level the noise should be reduced for each analysis window x on the basis of the representing value of the amplitude spectrum |IN (x, f)| of the amplitude spectrum of the inputted signal for each analysis window x and the noise reduction coefficient β(f) for each analysis window x (step S407). The calculation processing part 11 may calculate the value |OUT (x, f)| obtained by multiplying the |IN (x, f)| of the amplitude spectrum of the inputted signal by the noise reduction coefficient β(f) at the analysis window x to reduce the noise (step S408) and it may determine if the amplitude spectrum of the calculated inputted signal, namely, |OUT (xn, f)| is not less than the amplitude spectrum of the estimated target value or not (step S409).

When the calculation processing part 11 determines that the amplitude spectrum |OUT (x, f)| is not less than the amplitude spectrum of the target value |N (x, f)| (step S409: YES), the calculation processing part 11 determines that the noise is not reduced to the estimated target value level, namely, the noise is not reduced in excess, and then, it may output the amplitude spectrum |OUT (x, f)| of the analysis window x as it is (step S410). When the calculation processing part 11 determines that the amplitude spectrum |OUT (x, f)| is smaller than the amplitude spectrum of the target value |N (x, f)| (step S409: NO), the calculation processing part 11 determines that the noise is reduced over the estimated target value, namely, the noise is reduced in excess, and then, it may output the amplitude spectrum |OUT (x, f)| of the analysis window x to be replaced with the amplitude spectrum of the target value |N (x, f)| (step S411).

Figure 5A:
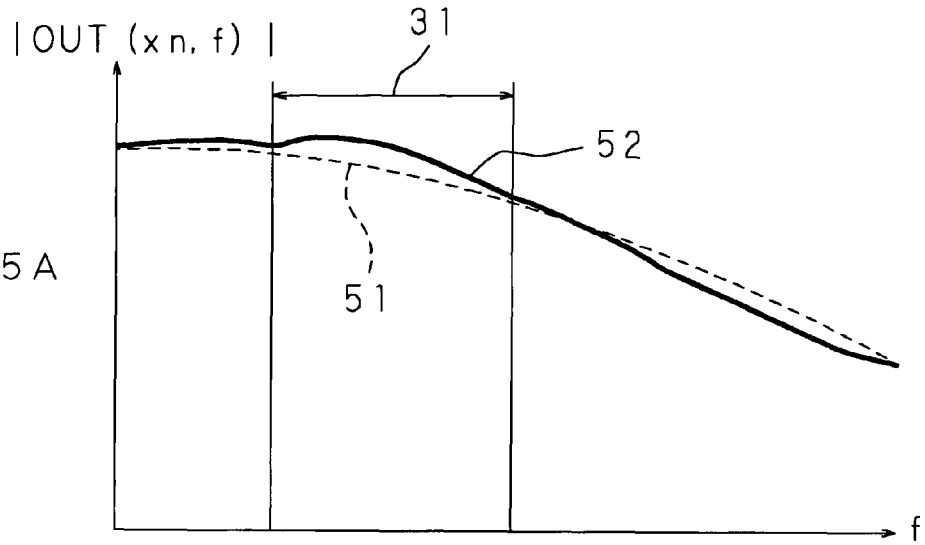
FIGS. 5A and 5B are views paternally showing a calculation method of an amplitude spectrum of an outputted signal at an arbitrary analysis window.
Figure 5B:
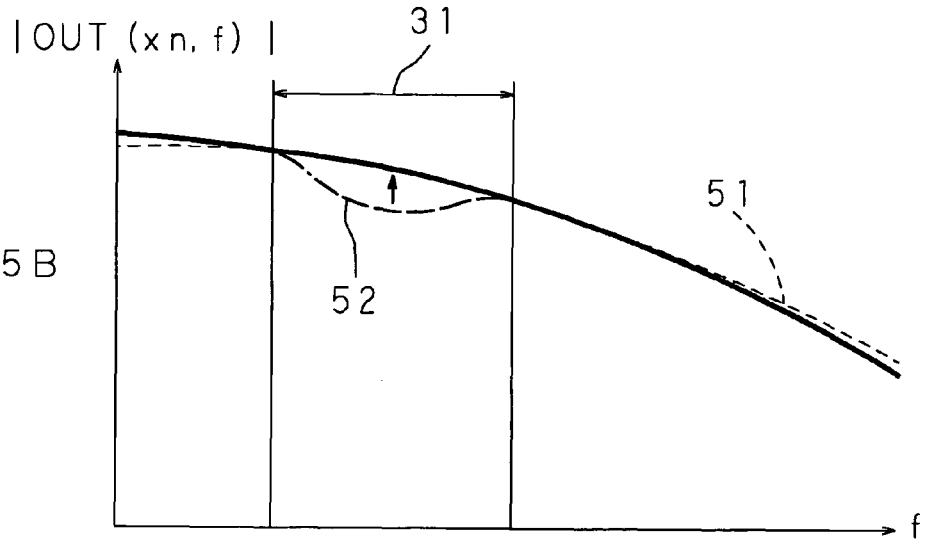

FIGS. 5A and 5B are views paternally showing a calculation method of the amplitude spectrum of the outputted signal |OUT (x, f)| at the arbitrary analysis window xn (n is a natural number). In FIG. 5A, in the noise band 31 of FIG. 3, a value 52 of the amplitude spectrum of the outputted signal |OUT (xn, f)| at the analysis window xn having the noise reduced by the noise reduction coefficient β(f) is larger than a value 51 of the amplitude spectrum of the target value |N (xn, f)|, so that the noise is not reduced in excess. Accordingly, the analysis window xn may output the value 52 of the amplitude spectrum of the outputted signal |OUT (xn, f)|. On the other hand, in FIG. 5B, in the band 31 of FIG. 3, the value 52 of the amplitude spectrum of the outputted signal |OUT (xn, f)| at the analysis window xn having the noise reduced by the noise reduction coefficient β(f) is smaller than the value 51 of the amplitude spectrum of the target value |N (xn, f)|, so that the noise is reduced in excess. Accordingly, the analysis window xn may output the value 51 of the amplitude spectrum of the target value |N (xn, f)| by which the value 52 of the amplitude spectrum of the outputted signal |OUT (xn, f)| is replaced.

Figure 6:
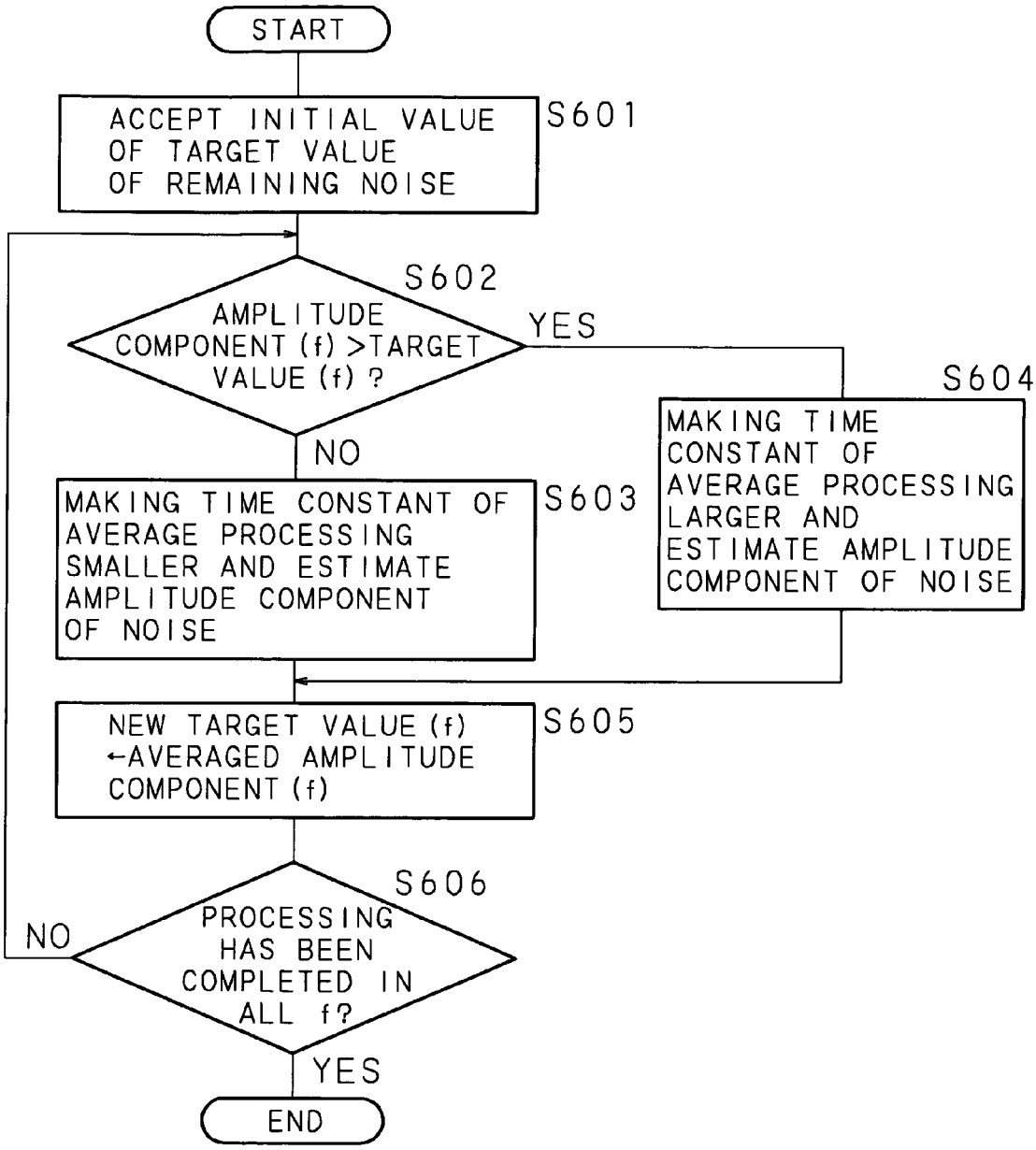
FIG. 6 is a flow chart showing a procedure of the target value estimating processing of the calculation processing part of the noise reducer according to the embodiment of the present invention.
Figure 7:
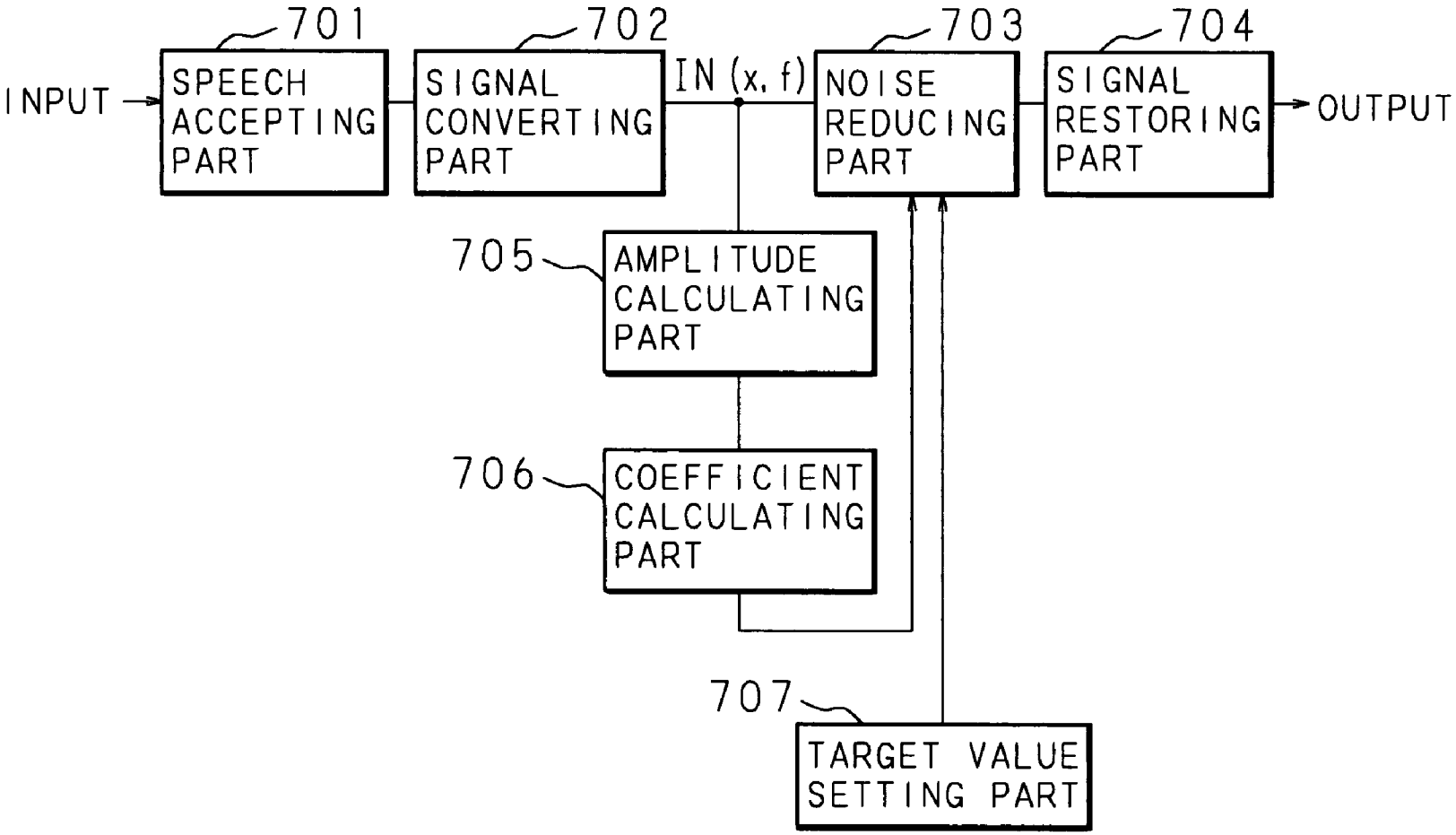
FIG. 7 is a block diagram showing a constitutional example of a conventional noise reducer.

The method of estimating the amplitude spectrum of the target value |N (xn, f)| to reduce the noise will be described more in detail. FIG. 6 is a flow chart showing a procedure of the target value estimating processing of the calculation processing part 11 of the noise reducer 1 according to the embodiment of the present invention.

The calculation processing part 11 of the noise reducer 1 may accept the initial value of the target value (f) at a predetermined frequency of the remaining noise (step S601). The initial value of the accepted target value (f) may be "0" or may be a predetermined constant. The calculation processing part 11 may determine if the value of the amplitude component (f) at a predetermined frequency f that is Fourier-transformed at a predetermined analysis window is larger than the target value (f) or not (step S602).

When the calculation processing part 11 determines that the value of the amplitude component (f) is not more than the target value (f) (step S602: NO), the calculation processing part 11 may estimate the amplitude component of the noise by setting a time constant for averaging the signal on the frequency axis lower than a predetermined value (step S603). When the calculation processing part 11 determines that the value of the amplitude component (f) is smaller than the target value (f) (step S602: YES), the calculation processing part 11 may estimate the amplitude component of the noise by setting the time constant for averaging the signal on the frequency axis higher than the predetermined value (step S604). In this case, the time constant can be determined by an average coefficient α(f) of the mathematical expression (1).

The calculation processing part 11 may set the amplitude component (f) of the estimated noise, namely, the value of the averaged amplitude component (f) as a new target value (f) (step S605), and then, the calculation processing part 11 may determine if the processing for estimating the amplitude component of the noise with respect to the all frequencies f has been completed or not (step S606).

When the calculation processing part 11 determines that the processing has not been completed (step S606: NO), changing the frequency f and returning the processing to the step S602, the calculation processing part 11 may repeat the above-described processing. When the calculation processing part 11 determines that the processing has been completed (step S606: YES), it may execute the noise reduction processing by using the target value (f) of the noise calculated for each frequency f.

As described above, according to the present embodiment, even when the speech signal other than the speech signal as the recognition target is superimposed and the speech input that cannot specify the period of time only including the stationary noise is accepted, without reducing the noise in excess, it is possible to output the speech without reducing the noise in excess, with less distortion, and with high quality substantially in real time. In addition, the target value to reduce the noise can be estimated for each frequency and the discontinuous point is hardly generated even at a boundary of the frequency band, so that generation of the noise such as a so-called musical noise or the like can be prevented.

Further, by using a microphone array that is configured by a plurality of microphones for the speech input part, it is possible to adjust a phase spectrum so as to correspond to a noise source upon reduction of the noise. For example, when the noise of generating the nonstationary noise can be specified, it is possible to reduce the noise more effectively.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A noise reducer comprising:

a speech accepting device that accepts a speech on which a noise is superimposed and converts the speech into a time-domain signal on a time axis of the speech;

a signal transforming part transforming the signal on the time axis of the speech into a frequency-domain signal on a frequency axis of the speech;

an amplitude calculating part calculating an amplitude component for each predetermined frequency band of the frequency-domain signal;

a noise target value estimating part estimating a noise target value |N (xn, f)| through the expression $$|N(xn,f)|=\alpha(f)|N(x(n-1),f)|+(1-\alpha(f))|IN(xn,f)|,$$

where |IN (xn, f)| is an amplitude of the accepted speech, |N (x(n−1), f)| is an amplitude of a noise target value in a last analysis window (x(n−1)), and α(f) is an average coefficient for each frequency;

a coefficient calculating part calculating a noise reduction coefficient to reduce the noise for each frequency band on the basis of the amplitude component calculated by the amplitude calculating part;

a noise reducing part multiplying the frequency-domain signal by the calculated noise reduction coefficient to obtain a reduced-noise converted signal on the frequency axis;

a comparator comparing an amplitude of the noise target value to an amplitude of the frequency-domain signal, wherein if the converted signal is equal to or larger in amplitude than an amplitude of the estimated noise target value, then the converted signal is not reduced in the reducing part, and wherein if the converted signal is smaller in amplitude than an amplitude of the estimated noise target value, then the converted signal is replaced by the noise target value in the reducing part;

a signal restoring part transforming the frequency-domain signal from the noise reducing part into another time-domain signal on the time axis; and a speech output device that outputs the another time-domain signal as sound.

2. The noise reducer according to claim 1, wherein the noise target value estimating part comprises:

means for accepting an initial value of the noise target value;

first determination means for determining whether an index value representing an amplitude component of a predetermined frequency band among the signals on the frequency axis converted by the signal converting part is larger than the noise target value or not;

means for setting a time constant for averaging the signal on the frequency axis of the frequency band being smaller than a predetermined value when the first determination unit determines that the index value is smaller than the noise target value, and being larger than the predetermined value when the first determination unit determines that the index value is larger than the noise target value, as to estimate the amplitude component of the noise;

means for setting the index value representing the estimated amplitude component of the noise as a new noise target value in the frequency band;

second determination means for determining whether the above-described processing has been completed in the all frequency bands or not;

and means for repeating the above-described processing when the second determination means determines that the processing has not been completed and sets the index value representing the amplitude component of the noise estimated for each frequency band as the noise target value of the reduced noise when the second determination means determines that the processing has been completed.

3. A noise reducer comprising a processor programmed to perform the steps of:

accepting speech having a noise superimposed thereon from a speech input device;

converting the speech into a signal on a time axis of the speech;

converting the signal on the time axis of the speech into a signal on a frequency axis;

calculating an amplitude component of a speech for each predetermined frequency band of the converted signal on the frequency axis;

calculating a noise reduction coefficient for reducing the noise for each frequency band on the basis of the calculated amplitude component;

estimating a noise target value |N (xn, f)| through the expression $$|N(xn,f)|=\alpha(f)|N(x(n-1),f)|+(1-\alpha(f))|IN(xn,f)|,$$

where |IN (xn, f)| is an amplitude of the accepted speech, |N (x(n−1), f)| is an amplitude of a noise target value in a last analysis window (x(n−1)), and α(f) is an average coefficient for each frequency;

reducing the noise component in the converted signal on the frequency axis by multiplying the signal on the frequency axis of the original signal by the calculated noise reduction coefficient;

restoring the signal on the frequency axis of which noise component is reduced into a signal on a time axis; and restoring a signal on a frequency axis in which a signal corresponding to a frequency band of which a target value estimated by the noise target value is larger than the value of the amplitude component of the signal on the frequency axis of which noise component is reduced by the noise reducing part is corrected to a signal corresponding to the noise target value estimated by the noise target value estimating part, into a signal on a time axis.

4. The noise reducer according to claim 3, comprising a processor for performing the steps of:

accepting an initial value of a noise target value of the reduced noise;

determining whether or not an index value representing an amplitude component of a predetermined frequency band among the converted signals on the frequency axis is equal to or larger than the noise target value;

setting a time constant for averaging the signal on the frequency axis of the frequency band being smaller than a predetermined value when determining that the index value is smaller than the noise target value, being larger than the predetermined value when determining that the index value is larger than the noise target value and being equal to the predetermined value when determining that the index value is equal to the noise target value, so as to estimate the amplitude component of the noise;

setting the index value representing the estimated amplitude component of the noise as a new noise target value in the frequency band;

determining if the above-described processing has been completed in the all frequency bands; and repeating the above-described processing when determining that the processing has not been completed and setting the index value representing the amplitude component of the noise estimated for each frequency band as the noise target value of the reduced noise when determining that the processing has been completed.

5. The noise reducer according to claim 3, comprising a preliminary step of providing the speech input device to perform the steps of accepting the speech and converting the speech into a signal on a time axis of the speech, and a final step of outputting the restored signal as sound.

6. A noise reducing method that causes a computer using a computer program to function as a noise reducer, the noise reducing method comprising:

providing a computer;

accepting a speech on which a noise is superimposed and converting it into a signal on a time axis of the speech by the computer;

converting the signal on the time axis of the speech into a signal on a frequency axis by the computer;

calculating an amplitude component of a speech for each predetermined frequency band of the converted signal on the frequency axis by the computer;

calculating a noise reduction coefficient for reducing the noise for each frequency band on the basis of the calculated amplitude component by the computer;

reducing the noise component in the converted signal on the frequency axis by multiplying the signal on the frequency axis of the original signal by the calculated noise reduction coefficient by the computer;

restoring the signal on the frequency axis of which noise component is reduced into a signal on a time axis by the computer;

estimating a noise target value |N (xn, f)| of the reduced noise for each frequency band, on the basis of the accepted speech by the computer, through the expression $$|N(xn, f)|=\alpha(f)|N(x(n-1), f)|+(1-\alpha(f))\ |IN(xn, f)|,$$

where |IN (xn, f)| is an amplitude of the accepted speech, |N (x(n−1), f)| is an amplitude of a noise target value in a last analysis window (x(n−1)), and α(f) is an average coefficient for each frequency;

restoring, by the computer, a signal on a frequency axis in which a signal corresponding to a frequency band of which a target value estimated by the noise target value is larger than the value of the amplitude component of the signal on the frequency axis of which noise component is reduced by the noise reducing part is replaced by a signal corresponding to the noise target value estimated by the noise target value estimating part, into a signal on a time axis; and outputting the restored signal from the computer to a speech-output device.

7. The noise reducing method according to claim 6, comprising the steps by the computer of:

accepting an initial value of a noise target value of the reduced noise;

determining whether or not an index value representing an amplitude component of a predetermined frequency band among the converted signals on the frequency axis is equal to or larger than the noise target value;

setting a time constant for averaging the signal on the frequency axis of the frequency band being smaller than a predetermined value when determining that the index value is smaller than the noise target value, being larger than the predetermined value when determining that the index value is larger than the noise target value and being equal to the predetermined value when determining that the index value is equal to the noise target value, so as to estimate the amplitude component of the noise;

setting the index value representing the estimated amplitude component of the noise as a new noise target value in the frequency band;

determining if the above-described processing has been completed in the all frequency bands; and repeating the above-described processing when determining that the processing has not been completed and setting the index value representing the amplitude component of the noise estimated for each frequency band as the noise target value of the reduced noise when determining that the processing has been completed.

8. A non-transitory recording medium, storing a computer program, wherein the computer program stored in the recording medium comprises the steps of:

causing the computer to accept a speech on which a noise is superimposed and convert it into the signal on the time axis of the speech;

causing the computer to convert the signal on the time axis into the signal on the frequency axis;

causing the computer to calculate an amplitude component for each predetermined frequency band of the converted signal on the frequency axis;

causing the computer to calculate a noise reduction coefficient that reduces the noise for each frequency band on the basis of the calculated amplitude component;

causing the computer to reduce the noise component in the converted signal on the frequency axis by multiplying the signal on the frequency axis of the original signal by the calculated noise reduction coefficient;

causing the computer to restore the signal obtained by the reduction on the frequency axis the signal on the time axis; causing the computer to estimate a noise target |N (xn, f)| value of the reduced noise for each frequency band, on the basis of the accepted speech, through the expression $$|N(xn, f)|=\alpha(f)|N(x(n-1), f)|+(1-\alpha(f))|IN(xn, f)|,$$

where |IN (xn, f)| is an amplitude of the accepted speech, |N (x(n−1), f)| is an amplitude of a noise target value in a last analysis window (x(n−1)), and α(f) is an average coefficient for each frequency;

causing the computer to restore a signal on a frequency axis in which a signal corresponding to a frequency band of which a target value estimated by the noise target value is larger than the value of the amplitude component of the signal on the frequency axis of which noise component is reduced by the noise reducing part is replaced by a signal corresponding to the target value estimated by the noise target value estimating part into a signal on a time axis.

9. The non-transitory recording medium according to claim 8, storing a computer program, wherein the computer program stored in the recording medium comprises the steps of:

causing the computer to accept an initial value of a noise target value of the reduced noise;

causing the computer to determine whether or not an index value representing an amplitude component of a predetermined frequency band among the converted signals on the frequency axis is equal to or larger than the noise target value;

causing the computer to set a time constant for averaging the signal on the frequency axis of the frequency band being smaller than a predetermined value when determining that the index value is smaller than the noise target value, being larger than the predetermined value when determining that the index value is larger than the noise target value and being equal to the predetermined value when determining that the index value is equal to the noise target value, so as to estimate the amplitude component of the noise;

causing the computer to set the index value representing the estimated amplitude component of the noise as a new target value in the frequency band;

causing the computer to determine if the above-described processing has been completed in the all frequency bands; and causing the computer to repeat the above-described processing when determining that the processing has not been completed and set the index value representing the amplitude component of the noise estimated for each frequency band as the target value of the reduced noise when determining that the processing has been completed.

* * * * *